United States Patent [19]

Rispoli

[11] 4,228,549

[45] Oct. 21, 1980

[54] DEODORIZER FOOTWEAR

[76] Inventor: John L. Rispoli, 1304 Huron Ave., New Castle, Pa. 16101

[21] Appl. No.: 829,522

[22] Filed: Aug. 31, 1977

[51] Int. Cl.[2] ..... A41B 11/00; A43B 17/00

[52] U.S. Cl. ..... 2/239; 2/53; 264/211; 424/65

[58] Field of Search ..... 2/239, 409, 53, 54, 2/55, 58; 424/74, 125, 65, 76; 264/211; 36/43, 44; 12/128 B

[56] References Cited

U.S. PATENT DOCUMENTS 1,144,291 6/1915 Boyer ..... 36/43

3,842,519 10/1974 Lapidus ..... 2/53 X

FOREIGN PATENT DOCUMENTS 2007860 9/1971 Fed. Rep. of Germany ..... 2/239

104256 8/1975 Japan ..... 264/211

1270809 4/1972 United Kingdom ..... 2/53

*Primary Examiner*—H. Hampton Hunter

*Attorney, Agent, or Firm*—Webster B. Harpman

[57] ABSTRACT

Footwear comprising socks or stockings are woven of a synthetic resin yarn in which activated charcoal is present in powder and small particle form in sufficient quantities to deoderize foot odors that may be present when the socks or stockings are worn.

5 Claims, 3 Drawing Figures

DEODORIZER FOOTWEAR

BACKGROUND OF THE INVENTION (1) Field of the Invention

This invention relates to footwear such as socks or stockings incorporating materials capable of absorbing perspiration and counteracting foot odor.

(2) Description of the Prior Art

Prior efforts at providing materials for footwear and the like may be seen in U.S. Pat. Nos. 1,144,291, 3,842,519, 3,852,897 and 4,015,347. Each of these patents discloses an insole treated with materials acting as deoderizers.

U.S. Pat. No. 1,144,291 discloses an insole formed of felt and treated with a mixture of zinc, peroxide and perborate of soda. The treated insole is then cemented to a shoe.

U.S. Pat. No. 3,842,519 discloses a sole shaped sheet of foamed latex in which several materials including activated charcoal are mixed prior to foaming and curing.

U.S. Pat. No. 3,852,897 discloses an insole comprising a fibrous web of wood fibers carried on a fabric sheet with active carbon in the fiber layer and patent 4,015,347 discloses an insole which has a metallic layer on the surface of a base, the metallic layer including silver, copper or an alloy of these metals.

The present invention utilizes a synthetic resin such as polyester in which powdered or small particle activated charcoal is present in an amount between about 20% and 40% of the total volume. The resin containing the activated charcoal is pressure extruded to form a yarn suitable for use in conventional stocking or sock knitting machines to form the article of the present invention.

SUMMARY OF THE INVENTION

Footwear woven in a conventional manner in the form of socks or stockings from a yarn formed of a synthetic resin such as polyester in which a desirable and effective quantity of activated charcoal is present will be found to effectively absorb and/or deodorize perspiration and foot odors and be capable of being washed in a normal manner and dried with the drying process reactivating the activated charcoal for repeated use.

DESCRIPTION OF THE PREFERRED EMBODIMENT

Figure 1:
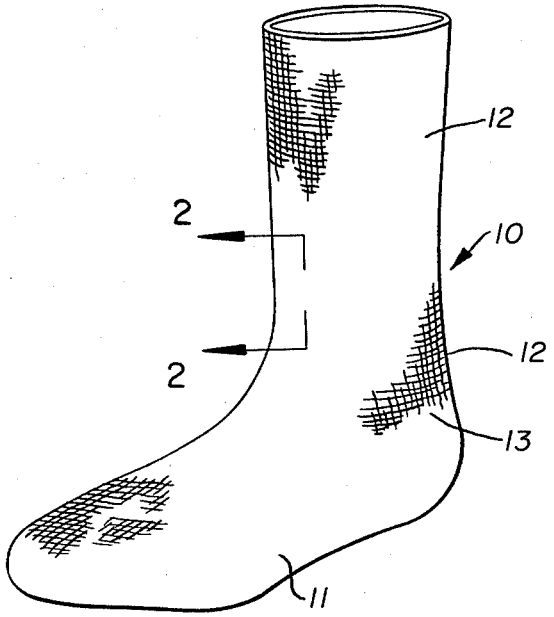
FIG. 1 is a perspective view of an article of footwear comprising a sock formed in accordance with this invention.

In its simplest form the deoderizing footwear disclosed herein comprises a sock such as generally indicated at 10 in FIG. 1 of the drawings and including a foot portion 11 and an ankle portion 12. The sock 10 is woven of warp and woof yarns 12 and 13, or they may be alternately double knit as known in the art, and the yarns from which the sock 10 is woven are formed of a synthetic resin such as polyester in which a quantity of activated charcoal is present in powdered or small particle form in an amount between 20% and 40% of the material.

Figure 2:
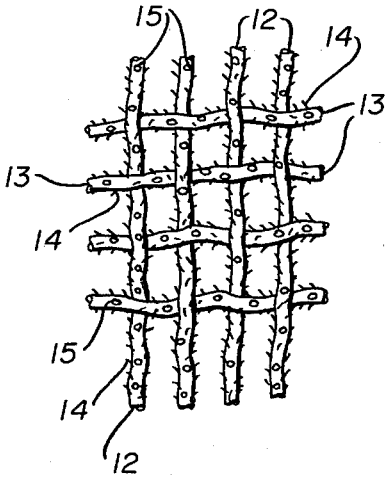
FIG. 2 is a greatly enlarged section of the woven material of the article of footwear seen in FIG. 1 and taken on line 2–2 thereof.

By referring now to FIG. 2 of the drawings, a greatly enlarged section of a small portion of the sock seen in FIG. 1 is illustrated and it will be seen that the warp threads 12 and the woof threads 13 are woven in the usual manner and it will be recognized that each of these warp and woof threads may actually comprise a plurality of the polyester yarn filaments as pressure extruded.

As illustrated in FIG. 2 of the drawings, the warp and woof threads 12 and 13 will be seen to have a plurality of surface irregularities 14 as occur when a plurality of fine yarn filaments are spun together to produce a thread suitable for forming a garment or the like. It will additionally be seen that the warp and woof threads as illustrated in FIG. 2 of the drawings, have a plurality of particles of activated charcoal 15 on or partially extending from the surfaces of the yarn filaments or threads formed therefrom.

The utilization of activated charcoal in powdered or particle form dispersed through the yarn filaments and the threads formed therefrom, provide a perspiration absorbing and odor neutralizing vehicle in each of the threads from which the article of footwear is woven so that the article is effective in its intended purpose when worn.

Figure 3:
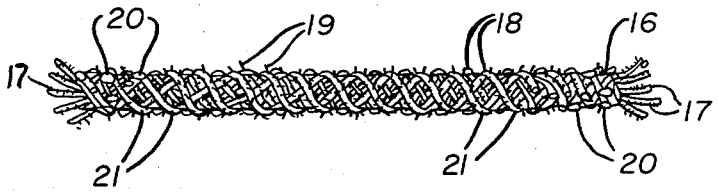
FIG. 3 is an enlarged detail of two sizes of yarn used in forming an article of footwear with a fluffy characteristic.

It will occur to those skilled in the art that unusually thick or fluffy articles of footwear, such as athletic socks and the like, can be formed by utilizing thicker threads formed of larger yarn filaments, all of which include comparable quantities of activated charcoal as in the form of the invention hereinbefore described and by referring to FIG. 3 of the drawings a typical woof thread 16 may be seen formed of a number of yarn filaments 17 with loosely wound or spun smaller yarn filaments 18 thereabout. Portions of the yarn filaments 17 extend out to form a nap-like surface 19 and all of the yarn filaments 17 and 18 incorporate particles of activated charcoal 20 with the very fine yarn filaments incorporating powdered charcoal 21.

It will occur to those skilled in the art that by building activated charcoal into the yarns from which the threads are formed from which the article of footwear disclosed herein is woven produces a widely distributed pattern of activated charcoal particles and powder in a position to intimately contact the foot of the wearer of the article of footwear so that objectionable perspiration and/or foot odors are effectively absorbed and/or deodorized. A suitable activated charcoal for use in the yarns from which the article of footwear disclosed herein is formed is available under the trade name NU-CHAR and a typical mixture would comprise 30% activated charcoal and 70% polyester.

In addition to the polyester resin hereinbefore specified, other thermoplastic resins including polyethylene, polypropylene, polyvinyl, alcohol and polyacetate may be used. The mixture of the resin and activated charcoal are mixed and it will be seen that the charcoal replaces the usual fillers, such as calcium carbonate, diatomaceous earth and the like. After mixing, the material is pressure extruded in the usual yarn forming process as known in the art. The yarn filaments are then spun, as known to form threads from which the article of footwear is woven or knitted.

Although but one embodiment of the present invention has been illustrated and described, it will be apparent to those skilled in the art that various changes and modifications may be made therein without departing from the spirit of the invention and having thus described my invention what I claim is:

1. As a new article of manufacture an article of footwear comprising a sock or stocking, said article formed of a fabric, the yarns of said fabric formed of synthetic resin containing activated charcoal particles homogeneously distributed therein, said charcoal particles being present in, on and extending from the surface of said yarns in an amount effective to absorb odors when said article is subjected to contact with foot perspiration and to a passage of odor filled air through said fabric.

2. The article of claim 1 wherein the charcoal is present in amounts between about 20% to about 40%.

3. The article of claim 1 and wherein the charcoal is present in the amount of about 30%.

4. The article of claim 1 and wherein the activated charcoal is present in both powdered and particle form.

5. The article of claim 1 and wherein the synthetic resin is chosen from a group including polyethylene, polypropylene, polyvinyl chloride, polyamide, polyester, polyvinyl alcohol and polyacetal.

* * * * *